US009394684B1

(12) United States Patent
Junkin

(10) Patent No.: US 9,394,684 B1
(45) Date of Patent: Jul. 19, 2016

(54) METHOD AND APPARATUS FOR AN IMPROVED AIR BARRIER SYSTEM

(71) Applicant: Fiberlock Technologies, Inc., Andover, MA (US)

(72) Inventor: Angus Junkin, Andover, MA (US)

(73) Assignee: Fiberlock Technologies, Inc., Andover, MA (US)

( * ) Notice: Subject to any disclaimer, the term of this patent is extended or adjusted under 35 U.S.C. 154(b) by 0 days.

(21) Appl. No.: 14/636,741

(22) Filed: Mar. 3, 2015

(51) Int. Cl.
*E04B 1/76* (2006.01)
*E04D 13/17* (2006.01)
*F24F 7/02* (2006.01)

(52) U.S. Cl.
CPC ..... *E04B 1/767* (2013.01); *E04B 1/7658* (2013.01); *E04D 13/178* (2013.01); *F24F 7/02* (2013.01); *Y10T 428/237* (2015.01)

(58) Field of Classification Search
CPC ..... E04D 13/178; F24F 7/02; E04B 1/767; E04B 1/7658; Y10T 428/237
See application file for complete search history.

(56) References Cited

U.S. PATENT DOCUMENTS 3,863,553 A * 2/1975 Koontz ..... F24F 7/00 454/260
4,096,790 A * 6/1978 Curran ..... F24F 7/02 454/260
4,184,416 A * 1/1980 Koontz ..... E04D 13/178 454/260
4,185,433 A * 1/1980 Cantrell ..... E04D 13/178 52/94
4,189,878 A * 2/1980 Fitzgerald ..... F24F 7/04 454/260
4,581,861 A * 4/1986 Eury ..... E04D 13/178 52/199
4,611,443 A * 9/1986 Jorgensen ..... E04D 13/178 454/260
4,660,463 A * 4/1987 Bottomore ..... E04D 13/178 454/260
5,007,216 A * 4/1991 Pearson ..... E04B 1/74 454/260
5,765,318 A * 6/1998 Michelsen ..... D04H 13/002 428/43
5,817,387 A * 10/1998 Allwein ..... B32B 3/00 428/131
5,848,509 A * 12/1998 Knapp ..... B32B 5/26 428/36.1
6,346,040 B1 * 2/2002 Best ..... E04D 13/178 454/260
6,347,991 B1 * 2/2002 Bogrett ..... F24F 7/02 454/250
6,579,586 B1 * 6/2003 Fay ..... E04B 1/767 428/192
6,732,960 B2 5/2004 Shaw et al.
7,094,145 B2 * 8/2006 Rye ..... B26F 1/20 454/365
7,143,557 B1 * 12/2006 Ayers, Jr. ..... E04D 13/152 454/250
7,165,368 B2 1/2007 Knapp
2003/0008093 A1 * 1/2003 Ray ..... B32B 27/18 428/36.91
2007/0151177 A1 * 7/2007 Mumaw ..... F24F 7/02 52/198
2007/0283639 A1 * 12/2007 Kortuem ..... E04D 13/17 52/198
2010/0064602 A1 * 3/2010 Moore ..... E04D 13/1625 52/95
2010/0146892 A1 * 6/2010 Rider, Jr. ..... E04D 13/178 52/302.3
2012/0141719 A1 * 6/2012 Payne ..... B32B 3/266 428/68
2013/0276402 A1 * 10/2013 Madison ..... F24F 7/02 52/741.4
2014/0366480 A1 * 12/2014 Smith ..... B01D 5/0057 52/741.4

FOREIGN PATENT DOCUMENTS

CA 1197967 12/1985

* cited by examiner

*Primary Examiner* — Andrew J Triggs

(57) ABSTRACT

Disclosed herein are methods and apparatuses for an improved air barrier system for use in residential or commercial buildings. An individual practicing the method, or an apparatus configured to practice the concepts disclosed herein, would insert an insulated envelope between joists located in a joist bay of a building, where the insulated envelope has a flap and the insulated envelope envelopes insulation. The user places the flap over insulation previously distributed on a floor of the joist bay, and applies an air impermeable coating over at least a portion of the flap of the insulation. By inserting the insulated envelope and applying an air impermeable coating over a flap and pre-existing insulation, the ability for attic vents to wind-wash conditioned air out of fiberous insulation is diminished.

12 Claims, 8 Drawing Sheets

METHOD AND APPARATUS FOR AN IMPROVED AIR BARRIER SYSTEM

BACKGROUND

1. Technical Field

The present disclosure relates to building insulation and more specifically to creating a continuous air impermeable barrier across a body of fibrous insulation to better reduce the flow of conditioned air out of a building envelope.

2. Introduction

Typical A-frame building design relies on an insulated attic to help retain heated or cooled air. Without attic insulation, temperature-regulated air would easily escape through the structure due to conduction. While insulation can help slow the loss of conditioned air, the conditioned air can also escape a structure if there are gaps and penetrations between conditioned and unconditioned spaces where air can easily transit. Traditional fibrous insulation (e.g. fiberglass, mineral wool or cellulose) is typically not air impermeable, and any gaps or openings in a building envelope that are not covered with an air barrier can allow air to easily flow through fibrous insulation, thereby stripping it of most, if not all, of its ability to retain conditioned air. Unconditioned attic spaces can be particularly susceptible to the effects of airflow caused either by wind or by convection. In the case of wind, airflow through a structure is affected by the force of wind blowing against a structure and subsequently being pushed or pulled through gaps in the building envelope. For example, unconditioned attics can accelerate the loss of conditioned air from within the conditioned space as they are often heavily ventilated and the ventilation can produce a wicking effect on the fibrous insulation located on the attic floor. In addition to wind, convective forces can produce internal pressure differentials that can push or pull air through a building envelope as well. In the building sciences world this is often referred to as the "stack effect". In cooler temperatures, less dense heated air can travel up through ceiling penetrations (light fixtures, gaps in vents, shafts, piping, etc.) and ultimately out through an unconditioned attic space. The reverse can also occur during warmer periods when denser air conditioned air causes warmer outside air to be drawn into a structure from unconditioned attic spaces and pushed out through gaps in the building envelope below the attic.

To combat the stack effect and to enhance the performance of fibrous insulation, insulators often utilize a combination of air and vapor barrier materials and careful sealing of gaps and penetrations to impede airflow between the internal conditioned living space and the unconditioned portion of an attic. This air sealing labor can easily exceed the cost of the insulation material and its installation. Still, if the air sealing is not performed utility bills for heating and cooling can be 30-50% higher in some situations.

Ventilation in an unconditioned attic space is also critical to preventing condensation and other moisture accumulation from causing wood rot and mold problems on building materials (especially the underside of roof sheathing and along roof trusses). As a result, soffit vents, ridge vents and gable vents are usually employed to help enhance airflow through an unconditioned attic space. Often ventilation baffles are utilized to provide conduits for air entering an attic from soffit vents to travel up the interior side of a roof and escape near the apex of the house through ridge vents, thereby helping to regulate temperatures within the attic and to help manage moisture accumulation on the underside of roof sheathing. Ventilation baffles can also prevent insulation from being in direct contact with the roof sheathing, which can impede airflow at soffits vents and produce a moisture problem that can eventually lead to mold and/or wood rot. While ventilation baffles are important they often are not sufficient to significantly reduce or eliminate "wind washing" which can occur when wind driven air is forced into the attic through attic vents and this air then pulls conditioned air out of exposed fibrous insulation. In some cases as much as 25% or more of conditioned air lost through an attic can be attributed to wind washing.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are methods and apparatuses for an improved monolithic air barrier for use in residential or commercial buildings. An individual practicing the method, or an apparatus configured to practice the concepts disclosed herein, would insert an air impermeable envelope filled with insulation material at the intersection of the floor joists and the roof joists between the top plate and roof sheathing. An area sometimes referred to as the joist or rafter bay end located near the roof line, where the insulated envelope has a flap and the insulated envelope envelopes insulation. In other configurations, the insertion point can be away from the intersection, in the "middle" of the attic floor or near an interior wall. The user places the flap over insulation previously distributed on the attic floor, and applies an air impermeable coating over at least a portion of the flap of the insulation. By inserting the insulated envelope and applying an air impermeable coating over a flap and over pre-existing insulation, the ability for soffit vents to wind-wash heat stored in the insulation is diminished. In addition, by placing a monolithic air barrier over the entire exposed face of the attic insulation the air barrier would remain unbroken across the entire exposed face of the attic insulation and potentially not require as much or any additional air sealing of penetrations below the attic insulation.

DETAILED DESCRIPTION

Methods and apparatuses are disclosed which provide an improved air barrier for insulating buildings. While examples are provided in the context of a residential home, the concepts disclosed herein can be equally applied to any structure, including commercial and other non-residential designs. As discussed above, an envelope is inserted between joists at the end of a joist bay of an attic or similar structure. The envelope is preferably insulated, and capable of storing insulation placed (or stuffed) into the envelope. In one configuration, the envelope can be closed or sealed, thereby enveloping the insulation. In another configuration, the envelope can remain open, acting only to hold the insulation in place (and impede air flow) rather than only enclose the insulation.

The envelope inserted between the floor joists can also have a flap, which can go over other insulation found in the floor joist bay or attic floor. The flap can be made of the same material as the main envelope, or can be made of a distinct material. The flap is placed over other insulation found in the floor joist bay. For example, if the attic previously had insulation between the floor joists, the envelope can be inserted on the top plate at the perimeter walls between the floor joists, next to previously distributed insulation. The flap of the envelope is then placed over the previously distributed insulation, and an air impermeable coating is applied over both the flap and the previously distributed insulation to create a continuous air barrier.

Various embodiments of the disclosure are described in detail below. While specific implementations are described, it should be understood that this is done for illustration purposes only. Other components and configurations may be used without parting from the spirit and scope of the disclosure.

Figure 1A:
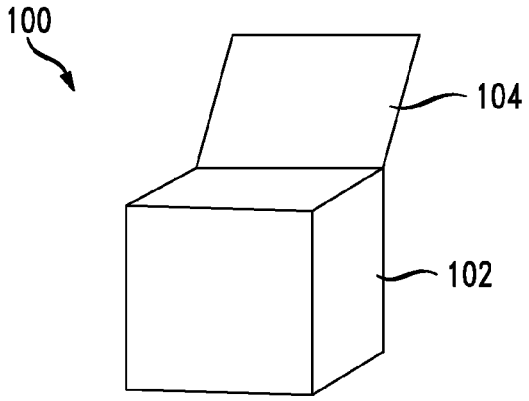
FIG. 1*a* illustrates an exemplary envelope with a flap in an open configuration.

FIG. 1*a* illustrates an exemplary envelope 100 with a flap 104 in an open configuration. The envelope 100 can be made of any material capable of containing fibrous insulation. Preferably, the envelope 100 is made of a nonwoven spunbond fiber material (and is therefore an "insulated envelope"), however configurations with material such as plastic, cloth, burlap, or any other material are also permitted. The envelope 100 contains a cavity 102 for storing/holding insulation material. Users and/or machines can insert insulation into the cavity 102, such that the envelope 100 holds the insulation in place. While the envelope 100 can take any shape or size, and can be based on the specific dimensions required by the structure receiving the envelope 100, an exemplary structure would be an envelope 100 which is eighteen inches deep, eighteen inches wide, eight inches thick, and has an eighteen inch long flap 104 which is eighteen inches wide, with the flap 104 attached to one side of the cavity 102, as illustrated.

Figure 1B:
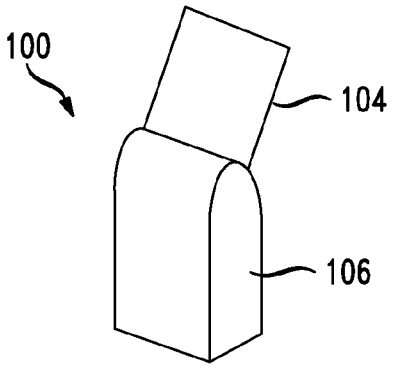
FIG. 1*b* illustrates an exemplary envelope with a flap in a closed configuration.

FIG. 1*b* illustrates an exemplary envelope 100 with a flap 104 in a closed configuration. Here, the envelope 100 cavity 106 has been filled with insulation and is ready for insertion into a joist bay. In addition, the envelope 100 cavity 106 has been closed. Such closing can occur via staples, Velcro, buttons, snaps, shoots/hooks, glue, or other securing mechanisms.

Figure 2:
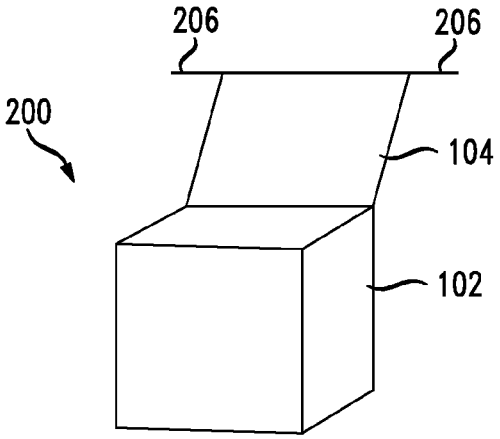
FIG. 2 illustrates an exemplary envelope with a flap in an open configuration, and a wire connected to the end of the flap.

FIG. 2 illustrates an exemplary envelope 200 with a flap 104 in an open configuration, with the cavity 102 exposed, and a wire 206 connected to the end of the flap 104 which is not attached to the envelope 100. The wire 206 provides means for securing the flap 104 in place over insulation. For example, if insulation has been previously distributed in the joist bay, upon inserting the envelope 100, the flap 104 would be placed over the previously distributed insulation and the wire 206 tensioned by and positioning the wire 206 between the joists in the joist bay or between the rafters located above the joist bay, thereby holding the flap 104 in place over the previously distributed insulation. Other configurations can use means other than the wire for holding the flap 104 in place. For example, the flap 104 can be configured with hooks, staples, or nails which embed themselves into the previously distributed insulation and hold it in place. Another configuration could use a weighted flap 104 to retain the flap in place over insulation.

"Previously distributed" insulation refers to insulation being in place for the flap to rest upon. Therefore, in one instance the envelope can be installed in the joist bay, the remaining space in the joist bay can be filled with insulation, and the flap of the envelope can be placed over the insulation which has been recently (but previously) distributed. In another instance, an attic can be filled with insulation, an envelope can be inserted, and the flap of the envelope can be placed over the previously distributed insulation.

Figure 3:
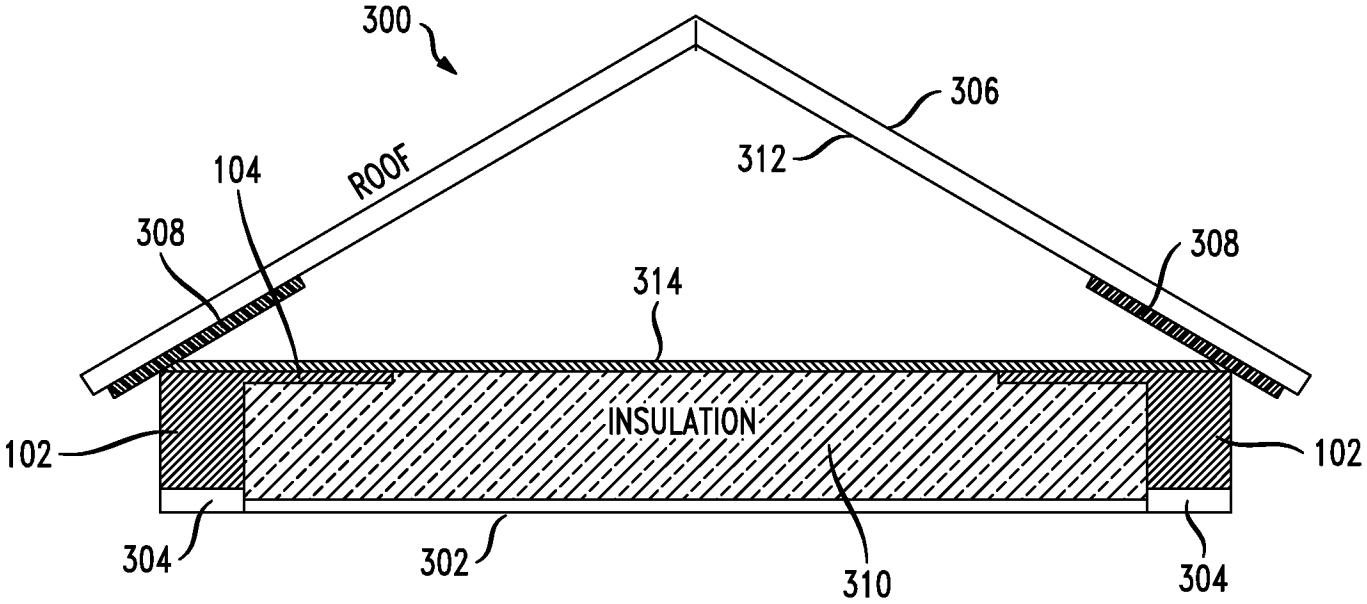
FIG. 3 illustrates an exemplary attic with envelopes inserted into the joist bay and covered with an air impermeable coating.

FIG. 3 illustrates an exemplary attic 300 with envelopes 102 inserted into the joist bay and covered with an air impermeable coating 314. In this example, the attic floor 302 is covered with insulation 310. A soffit pillow (envelope) 102 with a flap 104 is placed over the top plate 304 at the outer perimeter of the attic floor 302. The envelope 102, the flap 104, and the insulation 310, are covered with an air impermeable coating 314. In other configurations, only the flap 104 and the insulation 310 are covered with the coating 314. In yet other configurations, the coating 314 can be applied exclusively to the connection points between the flap 104 and the insulation 314, or to the flap 104 and envelope 102. The envelope 102 can be placed next to the baffle vent 308 attached to the interior 312 of the roof 306 such that the envelope 102 is touching the baffle vent. In other configurations, an air gap is left between the baffle vent 308 and the envelope 102.

As illustrated 300, with the soffit pillows 102, flaps 104, and air impermeable coating 314, an air impermeable "U" is formed around the insulation 310. The U-shape in three dimensions forms an upside-down bowl, or bathtub, formation which slows down the transfer of heated/cooled air. The U structure can cover the entire attic space, or can cover a specific portion of the attic space. In addition, some embodiments can be open on the sides (a true U-shape instead of a bowl) based on the configurations of the attic space or specific needs of the user. For example, stairs, duct work, varying types of insulation, insufficient air-impermeable coating, and other factors can result in only forming a U rather than a bowl.

Figure 4A:
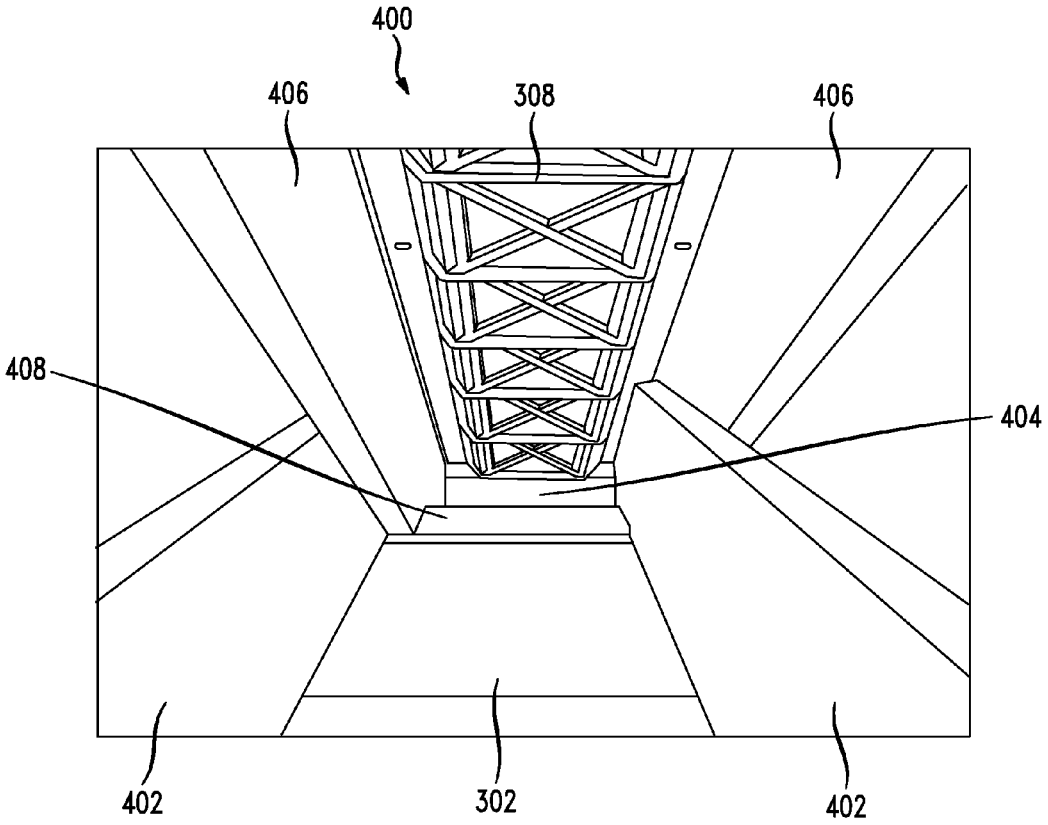
FIG. 4*a* illustrates an exemplary joist bay which is empty.

FIG. 4*a* illustrates an exemplary joist bay 400 which is empty. A user will insert both insulation and an envelope having a flap into this space, which corresponds to just above a top plate 408, place the flap over the insulation, and coat the envelope and insulation with an air impermeable coating. As illustrated, the joist bay 400 has an attic floor 302, horizontally placed joists 402 along the attic floor 302, a soffit vent (or area) 404, angled rafters 406 forming the base of the roof, and baffle vents 308 on the interior of the roof between the angled rafters 406.

Figure 4B:
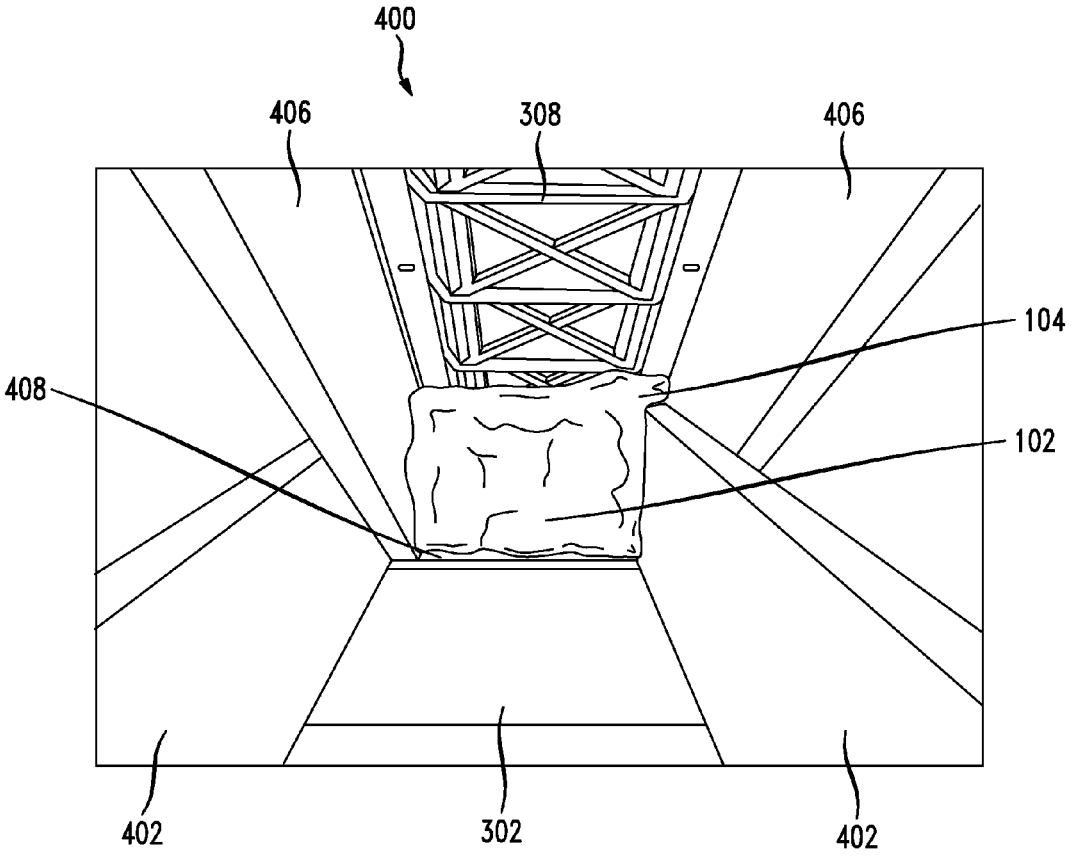
FIG. 4*b* illustrates an exemplary joist bay with insertion of an envelope.

FIG. 4*b* illustrates an exemplary joist bay 400 with insertion of an insulated envelope 102, having a flap 104. The envelope is placed near the intersection of the roof and the attic floor 302, such that air flow into the attic from the soffit area 404 is mostly redirected into the baffle vent 308. The top plate 408 is mostly covered by the insulated envelope 102.

Figure 4C:
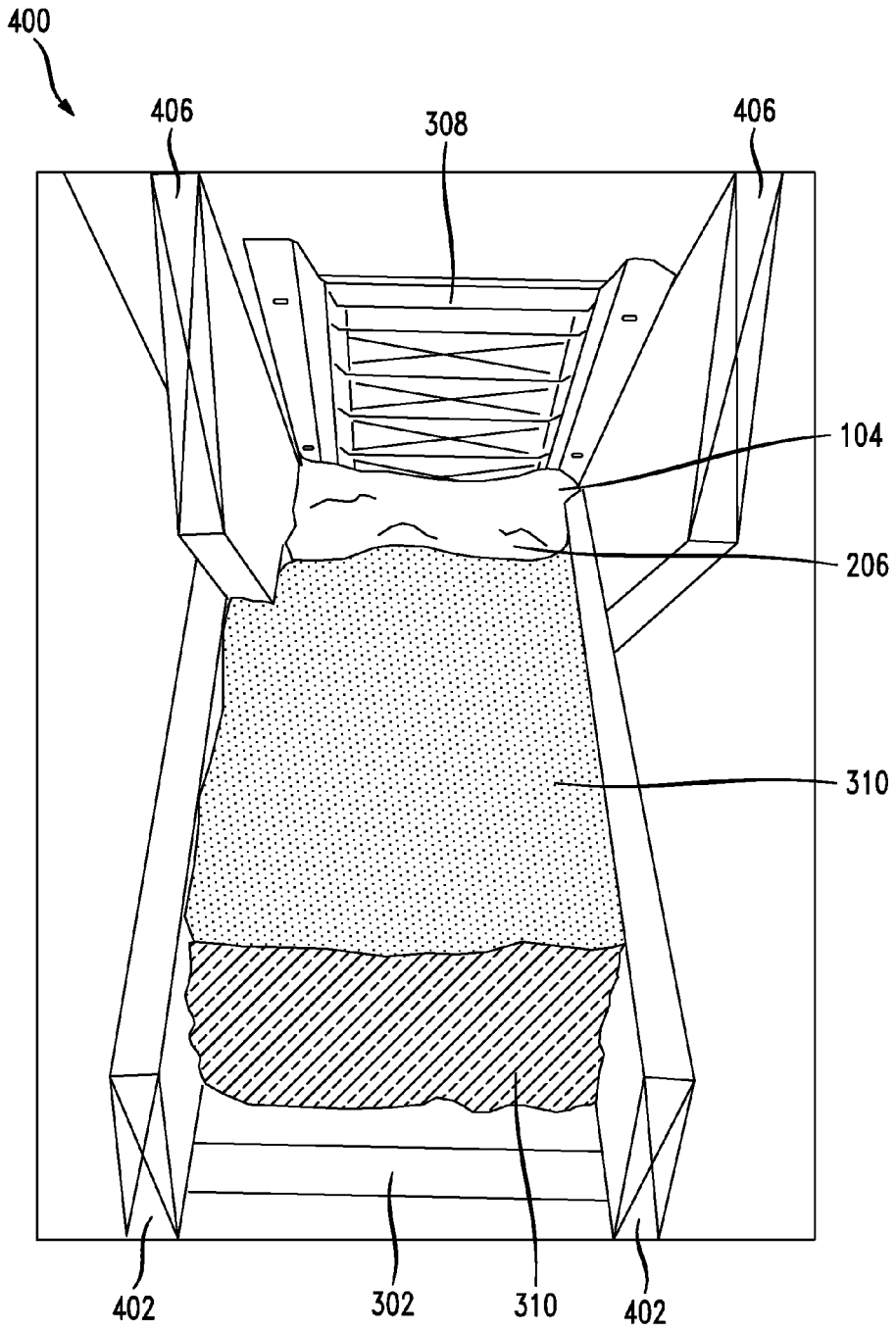
FIG. 4*c* illustrates an exemplary joist bay with an envelope and insulation.

FIG. 4*c* illustrates an exemplary joist bay 400 with insulation 310 and an insulated envelope. Because of the insulation, only the flap 104 of the envelope is visible. In this case, the flap 104 also has a steel spring wire 206 or other mechanism for securing the flap 104 over the insulation 310.

Figure 4D:
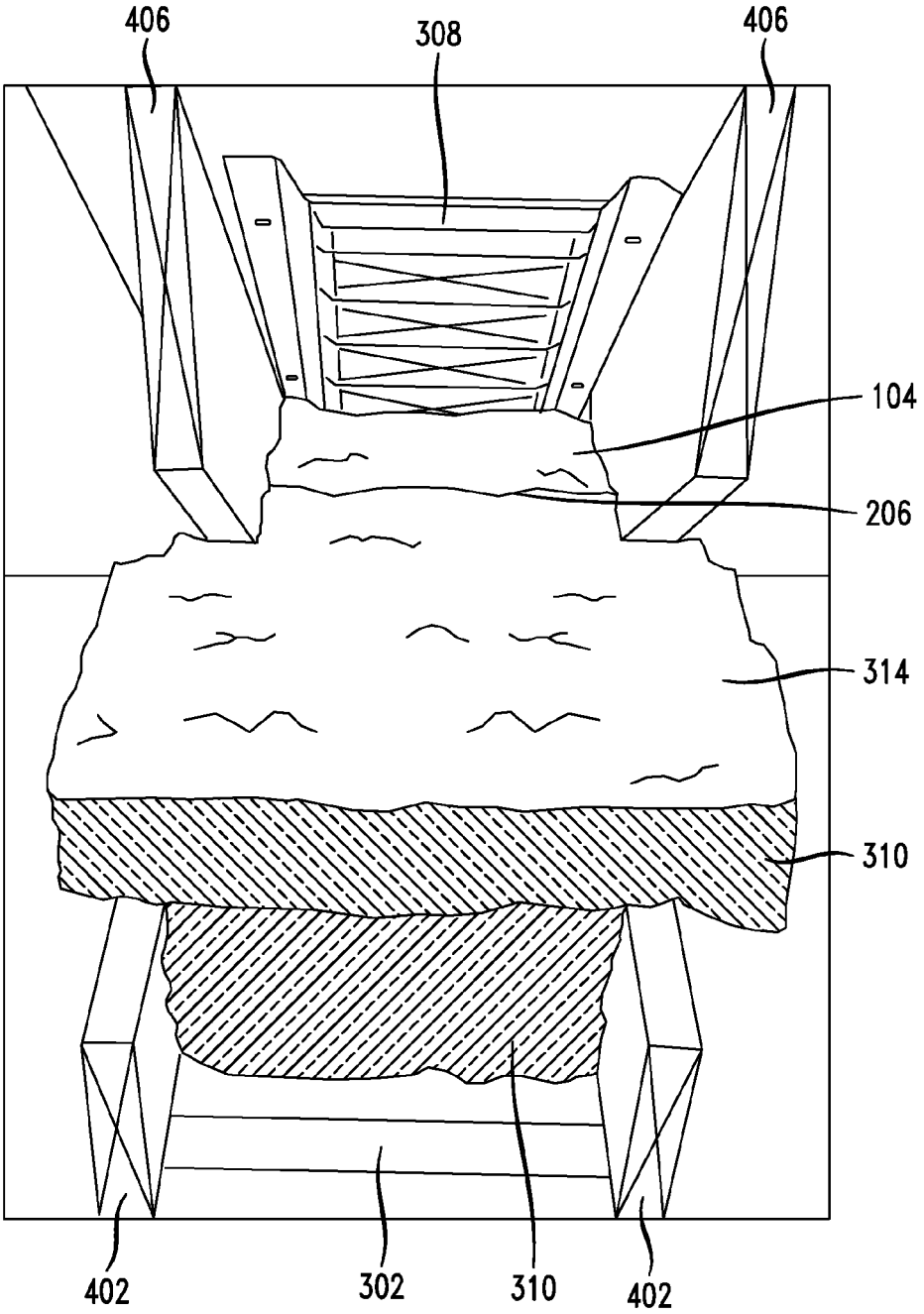
FIG. 4*d* illustrates an exemplary joist bay with an envelope and insulation, where an air impermeable coating has been applied over the envelope, a flap of the envelope, and the insulation.

FIG. 4*d* illustrates an exemplary joist bay with an insulated envelope and insulation 310, where an air impermeable coating 314 has been applied over the insulated envelope, a flap 104 of the insulated envelope, and the insulation 310. In this example, an additional layer of insulation 310 has been added (from the illustration in FIG. 4*c*), to which the flap 104 is attached. The air impermeable coating 314 can be applied over the flap 104, the securing mechanism 206, and the insulation 310, or can be applied over any combination of these elements.

Figure 5:
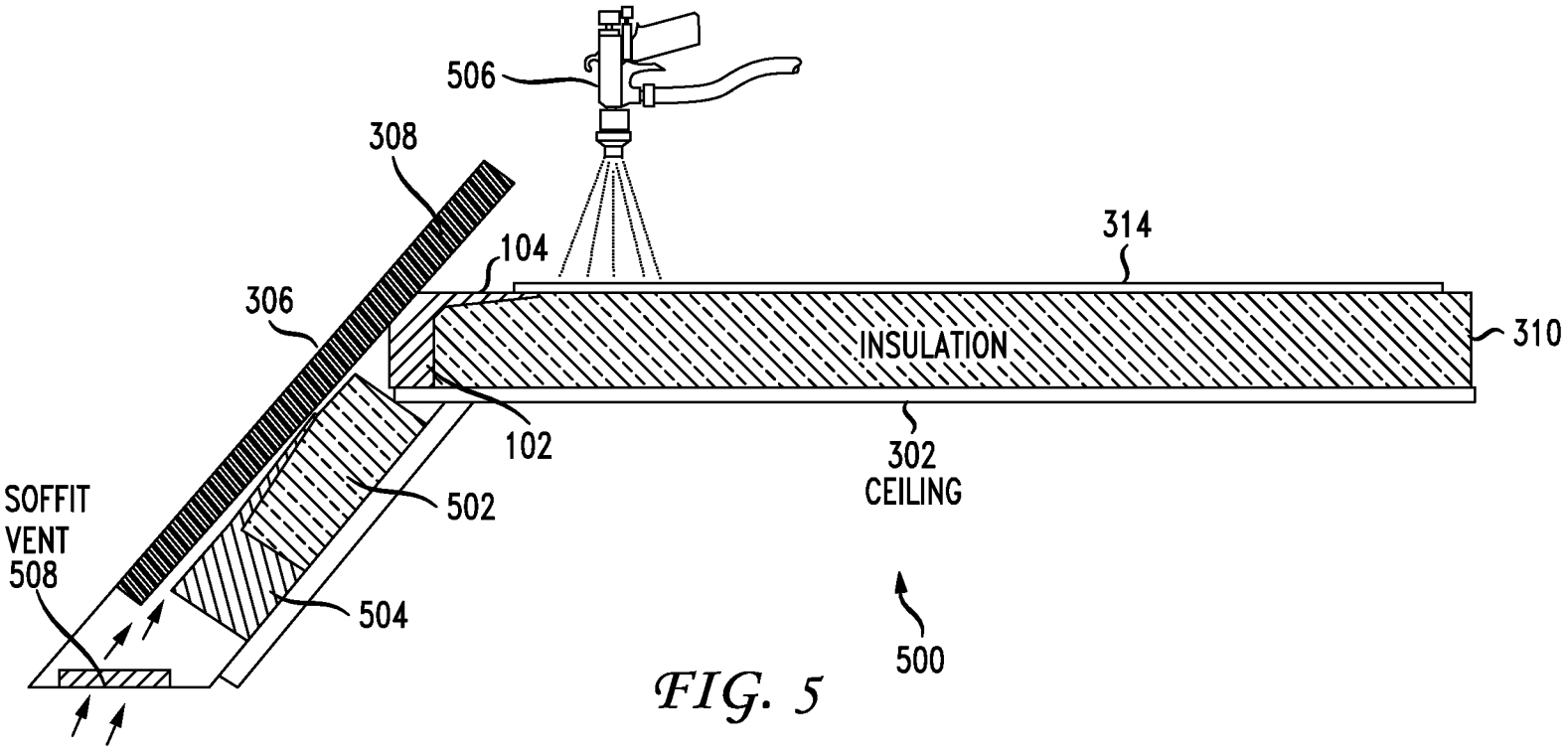
FIG. 5 illustrates an additional exemplary attic using multiple envelopes.

FIG. 5 illustrates an additional exemplary attic using multiple insulated envelopes 500. As illustrated, the ceiling 302 has insulation 310, with a soffit pillow 102 and flap 104, with the air impermeable coating 314 being applied by a coating or spray device 506. However, in this example the roof 306 and attached baffle vents 308 are angled and continue down to a soffit vent 508 below. A second soffit pillow 504 can be inserted above the soffit vent 508, next to other insulation 502 within the angled space. Multiple soffit pillows 102, 504 can therefore be used in a common system. If desired, additional (more than two) soffit pillows can be used if desired. In addition, the soffit pillows 102, 504 can be chained together using the flaps 104, securing mechanisms 206, the air-impermeable coating 314, and components.

In another similar, but distinct, embodiment, multiple layers of insulation 310 and soffit pillows 102 can be deployed. For example, if access to the joist bay/eave area is limited, a first soffit pillow 102 with a flap 104 can be deployed next to insulation 310, then another soffit pillow, flap, and layer of insulation can be deployed on top of the first layer. The double-layer can then be coated in air-impermeable coating. In addition, if desired, the first layer can be "sealed" by the air-impermeable coating before distributing the second "top" layer, thereby creating two stacked U-formations.

The insertion of the envelope can be vertical, horizontal, or angled as needed based on the specific configuration of the attic space. In addition, depending on space which needs to be filled and the size of the envelope, multiple envelopes can be placed directly next to one another rather than filling the entire space between joists 402.

Figure 6:
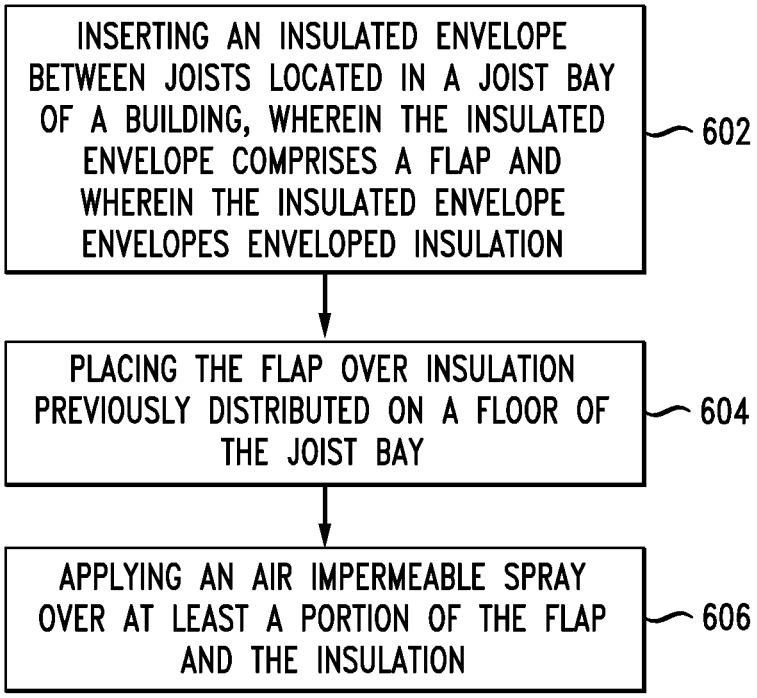
FIG. 6 illustrates an example method embodiment.

Having disclosed some basic system components and concepts, the disclosure now turns to the exemplary method embodiment shown in FIG. 6. The steps outlined herein are exemplary and can be implemented in any combination thereof, including combinations that exclude, add, or modify certain steps.

A user practicing the method inserts inserting an insulated envelope between joists located in a joist bay of a building, wherein the insulated envelope comprises a flap and wherein the insulated envelope envelopes enveloped insulation (602). The insulated envelope can be an air impermeable material, such as non-woven spunbond material, extruded materials, or woven materials. One exemplary non-woven spunbond materials can utilize polyethylene fibers, whereas other configurations could use polypropylenes or other polymers. Various configurations could also utilize a plastic bag for the insulated envelope material. Such materials can be laminated or coated in a film or coating to enable air/water impermeability as desired/required. The user places the flap over insulation previously distributed on a floor of the joist bay (604) and applies an air impermeable coating over at least a portion of the flap and the insulation (606). The flap can also have a wire/rod distally located from the insulated envelope, or other mechanisms (such as staples or weights) for securing the flap to the insulation and within the joist bay. The air impermeable coating can seal the portion of the flap and the insulation, or alternatively, can seal all of the flap and the insulation. If desired, additional envelopes can be inserted and used, and the area between the envelopes covered by the coating, creating an inverted U structure using two envelopes and insulation, all covered by air impermeable coating.

In some situations additional sealing may be required to fill gaps or voids not fully filled by the soffit pillow. Such sealing could, for example, be accomplished with a specially formulated bridging mastic material that is either applied by an airless sprayer, with a brush, paint roller, caulking tube, or with a painters mitt or gloved hand. In other situations the soffit area either in front of or behind the soffit pillow may need additional sealing of gaps. The mastic material used for sealing can be a specially formulated mastic material or a standard bridging/sealing material, and will serve to help further maintain a monolithic air barrier throughout the attic.

An air impermeable envelope, as disclosed herein, can have a cavity made of air impermeable material, having an open end, and a flap made of the air impermeable material, such as a nonwoven spunbond polyethylene or polypropylene synthetic fiber material that could be laminated or coated or plastic. For example, the envelope can be made using a combination of plastic bags with additional plastic flaps, or made using a commercial material such as Tyvek. The air impermeable envelope's flap can have a rod or wire distally located from the air impermeable envelope. The wire can be made of spring steel, carbon steel, or any other suitable material, which can be of varying lengths based on the needs of the user. The rod/wire can be flexible enough that, when inserted between joists, the wire bends, thereby creating tension/friction and holding the wire (and the flap) in place within the joist bay. Because the distance between joists in the bay can vary, the size of envelopes, flaps, and wires can vary, as required by the specific building. Exemplary lengths of the wire can be from 10 inches to 30 inches in length, and have exemplary gauges of 13-14. Other lengths and gauges outside of these exemplary ranges are also contemplated, based on the distance between joists and the amount of tension required. The cavity of the air impermeable envelope can be filled with insulation, then stapled, glued, or snapped shut.

As used herein, an air-impermeable material has an air permeance equal to or less than 0.02 l/s-m$^2$ at 75 Pa pressure differential when tested according to ASTM E2178. However, additional or distinct air-impermeable material testing or standards can also be applied to the concepts disclosed herein.

The various embodiments described above are provided by way of illustration only and should not be construed to limit the scope of the disclosure. For example, the principles herein apply equally to residential and commercial buildings, and various types of insulation. While various examples of fibrous insulation have been given, the concepts disclosed herein can be applied to any type of insulation material. Various modifications and changes may be made to the principles described herein without following the example embodiments and applications illustrated and described herein, and without departing from the spirit and scope of the disclosure.

We claim:

1. A method comprising:

inserting a first insulated envelope between joists located in a joist bay of a building, wherein the first insulated envelope comprises a first flap and wherein the first insulated envelope envelopes first enveloped insulation;

placing the first flap over floor distributed insulation previously distributed on a floor of the joist bay; and applying an air impermeable coating over at least a first flap portion of the first flap and a first insulation portion of the floor distributed insulation.

2. The method of claim 1, wherein the first insulated envelope is air impermeable.

3. The method of claim 2, wherein the first insulated envelope is made of a non-woven spunbond material.

4. The method of claim 1, wherein the first flap further comprises a wire distally located from the first insulated envelope.

5. The method of claim 1, wherein the applying of the air impermeable coating seals the first flap portion of the first flap and the first insulation portion of the floor distributed insulation.

6. The method of claim 1, further comprising:

inserting a second insulated envelope between second joists located in a joist bay of a building, wherein the second insulated envelope comprises a second flap and envelopes second enveloped insulation;

placing the second flap over a second insulation portion of the floor distributed insulation previously distributed on the floor of the joist bay, wherein the second insulation portion of the floor distributed insulation is distinct from the first insulation portion of the insulation, and wherein a third insulation portion of the floor distributed insulation covers an area of the joist bay between the first insulated envelope and the second insulated envelope; and applying an air impermeable coating over the third insulation portion of the floor distributed insulation and at least portions of the first flap and the second flap.

7. The method of claim 6, wherein the first flap and the second flap further comprise wires.

8. The method of claim 7, wherein the wires use friction to hold the first flap and the second flap in the joist bay.

9. The method of claim 8, wherein the wires are made of carbon steel.

10. The method of claim 6, wherein the applying of the air impermeable coating results in an inverted U structure, wherein the first insulated envelope and the second insulated envelope form sides of the inverted U structure and the third insulation portion of the insulation, upon application of the air impermeable coating, forms a middle of the inverted U structure.

11. The method of claim 10, wherein the inverted U structure is part of an inverted bowl structure when viewed in three dimensions.

12. An improved air barrier created by the process of claim 6.

* * * * *